US007512357B2

(12) United States Patent
Cellura et al.

(10) Patent No.: US 7,512,357 B2
(45) Date of Patent: Mar. 31, 2009

(54) IMAGE FORMING DEVICE ARRANGED WITH PLURAL PARTICLE REMOVAL DEVICES

(75) Inventors: Mark A. Cellura, Webster, NY (US); Donald J. Drake, Rochester, NY (US); Elliott A. Eklund, Penfield, NY (US); Richard P. Germain, Webster, NY (US); Scott J. Phillips, W. Henrietta, NY (US); Robert M. Rottman, Ontario, NY (US); Elias Panides, Whitestone, NY (US); Barry D. Reeves, Lake Oswego, OR (US)

(73) Assignee: Xerox Corporation, Norwalk, CT (US)

( * ) Notice: Subject to any disclaimer, the term of this patent is extended or adjusted under 35 U.S.C. 154(b) by 477 days.

(21) Appl. No.: 11/208,820

(22) Filed: Aug. 22, 2005

(65) Prior Publication Data

US 2007/0040886 A1 Feb. 22, 2007

(51) Int. Cl.
*G03G 15/14* (2006.01)

(52) U.S. Cl. ..... 399/93

(58) Field of Classification Search ..... 399/93, 399/98, 102, 355; 15/309.1; 347/88, 98
See application file for complete search history.

(56) References Cited

U.S. PATENT DOCUMENTS

| | | | | |
|---|---|---|---|---|
| 2,818,595 | A * | 1/1958 | Rosewall | 15/309.1 |
| 3,040,367 | A * | 6/1962 | Hellstrom | 15/371 |
| 5,028,959 | A * | 7/1991 | Gooray | 399/93 |
| 5,225,880 | A * | 7/1993 | Shehata et al. | 399/264 |
| 5,268,727 | A * | 12/1993 | Thayer et al. | 399/102 |
| 6,070,026 | A | 5/2000 | Clafflin, Jr. et al. | 399/92 |
| 6,481,840 | B1 * | 11/2002 | Mueller et al. | 347/88 |
| 6,871,028 | B2 * | 3/2005 | Rodriguez | 399/24 |

* cited by examiner

*Primary Examiner*—Stephen D Meier
*Assistant Examiner*—Alexander C Witkowski
(74) *Attorney, Agent, or Firm*—Gibb I.P. Law Firm, LLC.

(57) ABSTRACT

An image forming device includes marking material dispensers for disposing an image on an imaging drum surface. The image forming device further includes plural particle removal devices comprising first and second particle removal devices coupled to a vacuum source. The first particle removal device includes a first vacuum port positioned as close as possible to an included image transfer site. The second particle removal device includes a second vacuum port positioned as close as possible to the marking material dispensers. The first and second vacuum ports are positioned proximate to the imaging drum surface to provide respective first and second air flows.

32 Claims, 4 Drawing Sheets

IMAGE FORMING DEVICE ARRANGED WITH PLURAL PARTICLE REMOVAL DEVICES

INCORPORATION BY REFERENCE OF ANOTHER U.S. PATENT

The disclosure of U.S. Pat. No. 6,070,026, "Charging device with separate pressure and vacuum air flows", issued 30 May 2000 to Alfred J. Clafflin, Jr. et al., hereby is incorporated by reference, verbatim, and with the same effect as though the same disclosure were fully and completely set forth herein.

BACKGROUND OF THE INVENTION

It is known to use vacuum cleaning in image forming devices such as printing machines or printers.

For example, in xerographic printing architectures it is known to use vacuum devices to clean residual toner from the surface of a photoreceptor drum. Also in xerographic printing architectures, it is known to use vacuum devices to clean web-fed paper paths to promote general cleanliness, thereby preventing image quality defects due to stray paper dust particles.

It also is known to use vacuum cleaning in ink jet printing architectures. For example, in solid ink jet printers the media or paper introduces particulate contamination into the image exchange engine ("IME") where it can reach the apertures of the print heads, resulting in temporary, intermittent weak or missing ("IWM") or permanent, chronic weak or missing ("CWM") jet failures. Such IWM or CWM jet failures, in turn, reduce print quality and the mean number of copies between interventions ("MCBI"). Moreover, it is well known that particulate contamination can find its way into the small jetting orifices characteristic of ink jet printheads, and cause either temporary or permanent printhead failures.

Accordingly, it is known to use vacuum plenums to remove contaminating particles in ink jet printers, especially in the vicinity of the ink jet print heads.

Also, in solid ink printing architectures which use an intermediate image drum, it is known that vacuum cleaning of the image drum can remove such contaminants from the drum surface and from the entrained air boundary layer, thus reducing the contamination flux to the print head aperture plate.

Further, it has been shown that vacuum cleaning of the imaging drum just upstream of the print heads can remove these contaminants from the drum and the air boundary later, thus reducing the number of jet outages and increasing printer reliability.

However, there are substantial limitations with these existing methods to remove contaminating particles.

Thus, there is a need for the present invention.

BRIEF SUMMARY OF THE INVENTION

In a first aspect of the invention, there is described an image forming device including an imaging drum and one or more marking material dispensers arranged for forming a disposed image on an included imaging drum surface, the imaging drum arranged to transfer the disposed image to a media at an image transfer site, the image forming device including plural particle removal devices comprising at least a first particle removal device and a second particle removal device, the first particle removal device including a first vacuum port positioned such that the imaging drum rotates a first angle from the image transfer site to the first vacuum port, the second particle removal device including a second vacuum port positioned such that the imaging drum rotates a second angle from the second vacuum port to the one or more marking material dispensers.

In a second aspect of the invention, there is described an image forming device including an imaging drum and one or more marking material dispensers arranged for forming a disposed image on an included imaging drum surface, the imaging drum arranged to transfer the disposed image to a media at an image transfer site, the image forming device including plural particle removal devices comprising at least a first particle removal device and a second particle removal device, the first particle removal device including a first elongated slot positioned such that the imaging drum rotates a first angle from the image transfer site to the first slot, the second particle removal device including a second elongated slot positioned such that the imaging drum rotates a second angle from the second slot to the one or more marking material dispensers.

In a third aspect of the invention, there is described a printer including an imaging drum and one or more marking material dispensers arranged for forming a disposed image on an included imaging drum surface, the imaging drum arranged to transfer the disposed image to a media at an image transfer site; the printer including a first particle removal device and a second particle removal device; the first particle removal device including a first elongated slot positioned such that the imaging drum rotates a first angle from the image transfer site to the first slot, the first slot positioned as close as possible to the image transfer site; the second particle removal device including a second elongated slot positioned such that the imaging drum rotates a second angle from the second slot to the one or more marking material dispensers, the second slot positioned as close as possible to the one or more marking material dispensers; the first and second slots having respective shapes and sizes that are substantially identical; each slot comprising a slot length extending generally parallel to an included imaging drum axial and a slot width; the slot width comprising a slot width outboard value at an included slot outboard end and a smaller slot width inboard value at an included slot inboard end; the slot width value being substantially constant from the slot inboard end to a slot width-transition point located a slot constant-width portion length from the slot inboard end towards the slot outboard end, the slot width value gradually increasing from the slot width-transition point to the slot outboard end; the first particle removal device coupled to a vacuum source and the second particle removal device coupled to a vacuum source; the first slot 160 positioned proximate to the imaging drum surface to provide a first air flow and the second slot positioned proximate to the imaging drum surface to provide a second air flow; where the marking material comprises ink.

BRIEF DESCRIPTION OF THE SEVERAL VIEWS OF THE DRAWING

FIG. 3 also includes a reference line 4 that is coincident with the depicted first and second vacuum port centers 160' and 260'.

DETAILED DESCRIPTION OF THE INVENTION

Briefly, an image forming device includes marking material dispensers for disposing an image on an imaging drum surface. The image forming device further includes plural particle removal devices comprising first and second particle removal devices coupled to a vacuum source. The first particle removal device includes a first vacuum port positioned as close as possible to an included image transfer site. The second particle removal device includes a second vacuum port positioned as close as possible to the marking material dispensers. The first and second vacuum ports are positioned proximate to the imaging drum surface to provide respective first and second air flows.

Figure 1:
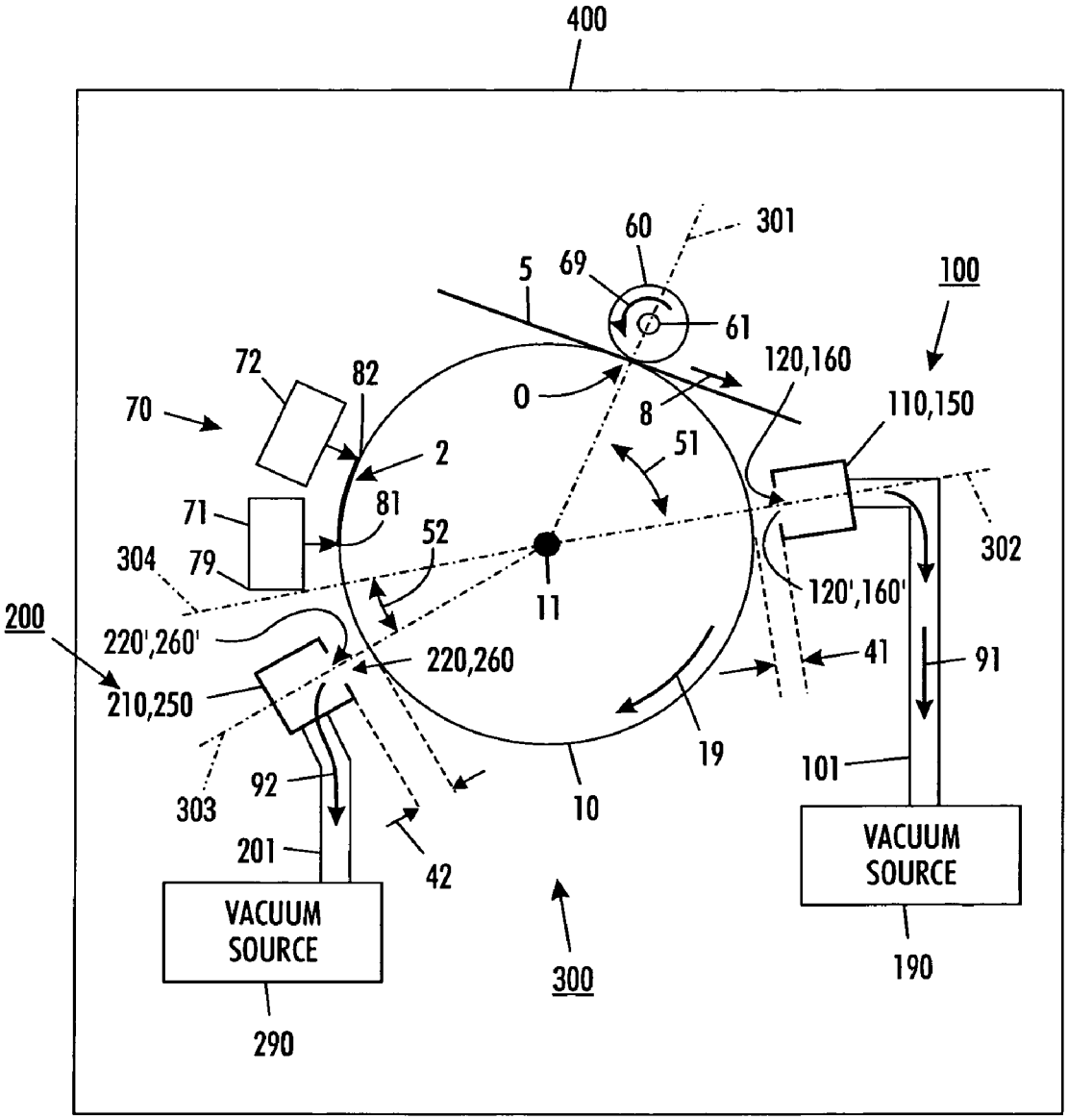
FIG. 1 depicts an image forming device 400 including an image disposing and transferring arrangement 300. The image disposing and transferring arrangement 300 includes plural particle removal devices comprising a first particle removal device 100 and a second particle removal device 200. The depicted first particle removal device 100 comprises a plurality of embodiments including the particle removal device 110 in FIG. 2 and the particle removal device 150 in FIGS. 3 and 4. Also, the depicted second particle removal device 200 comprises a plurality of embodiments including the particle removal device 210 in FIG. 2 and the particle removal device 250 in FIGS. 3 and 4. Also shown is an imaging drum 10. In one embodiment, the imaging drum 10 comprises a transfix drum. Also shown are four (4) imaging drum radials 301-304 radiating from an imaging drum axial 11.

Referring now to FIG. 1 there is depicted an image forming device 400 including an image disposing and transferring arrangement 300. As shown, the image disposing and transferring arrangement 300 comprises an imaging drum 10 and one or more marking material dispensers 71, 72 arranged for forming a disposed image 2 on an included imaging drum surface 16.

In one embodiment, the marking dispenser 71 comprises an ink jet print head.

In one embodiment, the marking dispenser 72 comprises an ink jet print head.

Figure 2:
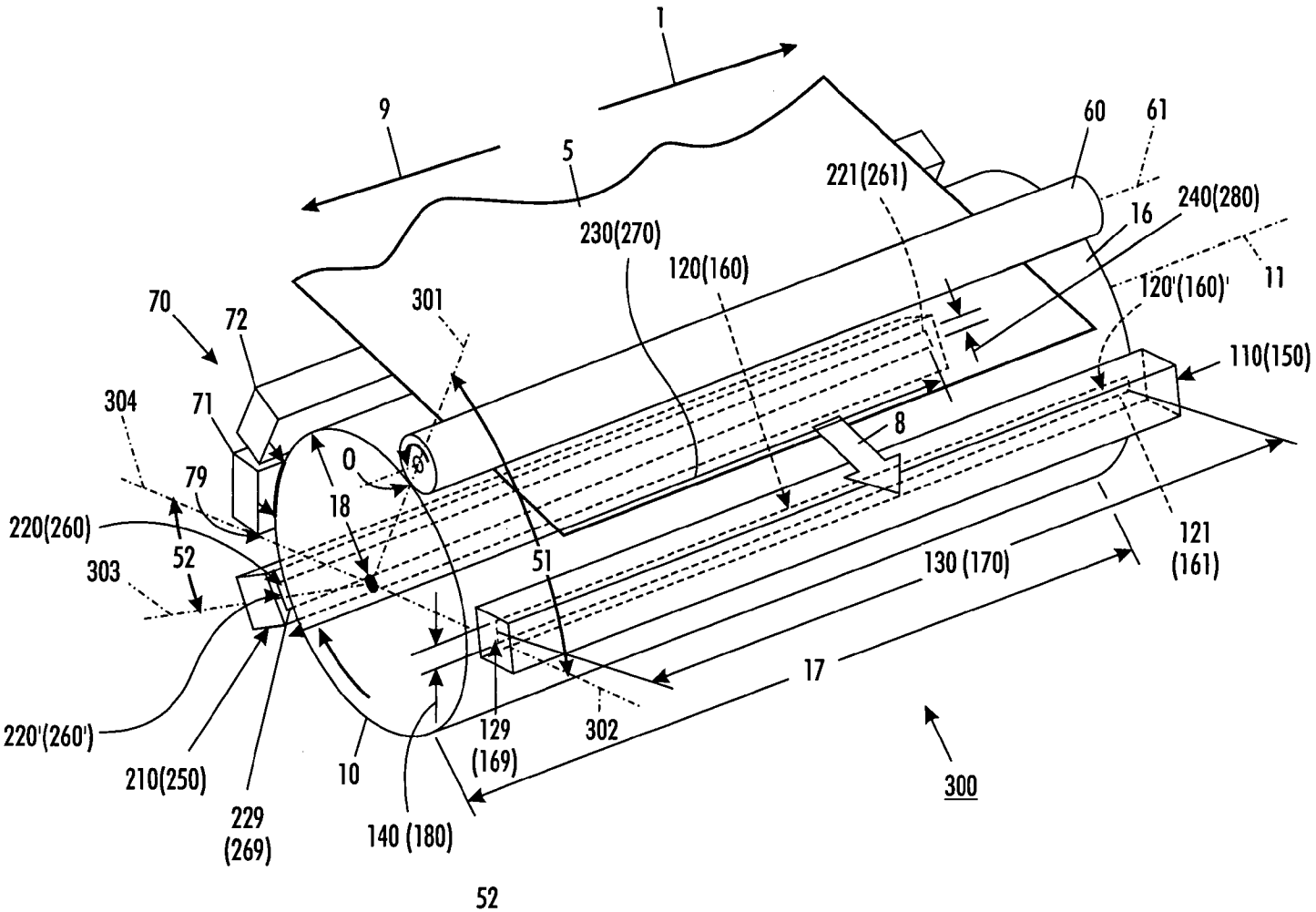
FIG. 2 further depicts the FIG. 1 image disposing and transferring arrangement 300. Also shown are the first and second particle removal devices 110 and 210. As depicted, in one embodiment the first and second particle removal devices 110 and 210 are substantially identical.

For good understanding, the one or more marking material dispensers or ink jet print heads 71, 72 are generally depicted in FIGS. 1 and 2 by the reference number 70.

Referring still to FIG. 1, in one embodiment, the imaging drum 10 comprises a transfix drum.

In one embodiment, the imaging drum 10 comprises an intermediate image drum.

Still referring to FIG. 1, in one embodiment, the image forming device 400 comprises a printing machine or printer.

In one embodiment, the image forming device 400 comprises an ink jet printer.

In FIG. 1 the disposing of the image on the imaging drum surface 16 is depicted by reference numbers 81 and 82. The imaging drum 10 is arranged to transfer the disposed image 2 to a media or paper 5 at an image transfer site 0.

In one embodiment, the image transfer site 0 comprises a transfix site, and the depicted element 60 comprises a corresponding transfix roller.

As shown, the image disposing and transferring arrangement 300 includes plural particle removal devices, where the plural particle removal devices comprise at least a first particle removal device 100 and a second particle removal device 200.

Figure 3:
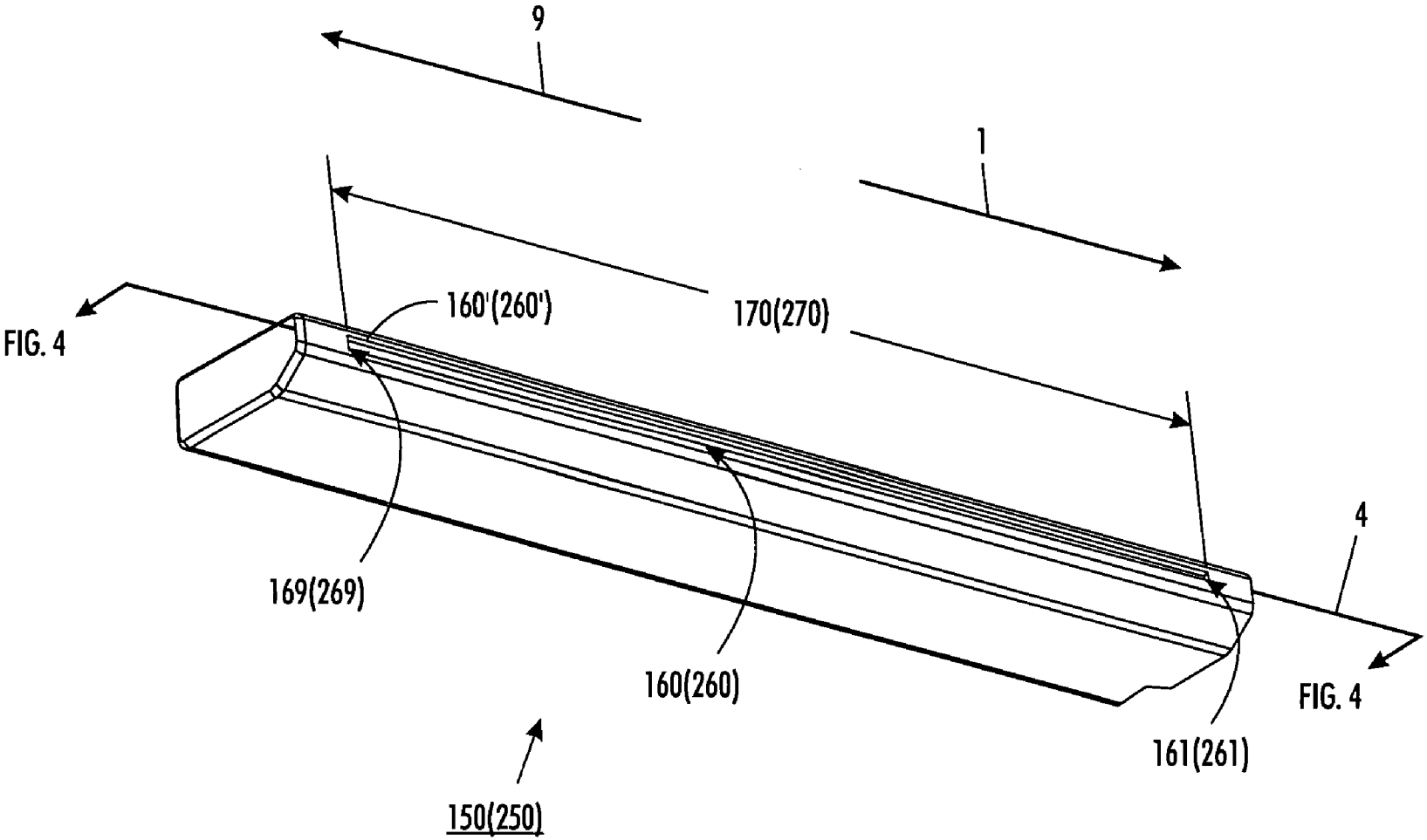
FIG. 3 depicts the first and second particle removal devices 150 and 250. As shown, in one embodiment the first and second particle removal devices 150 and 250 are substantially identical.
Figure 4:
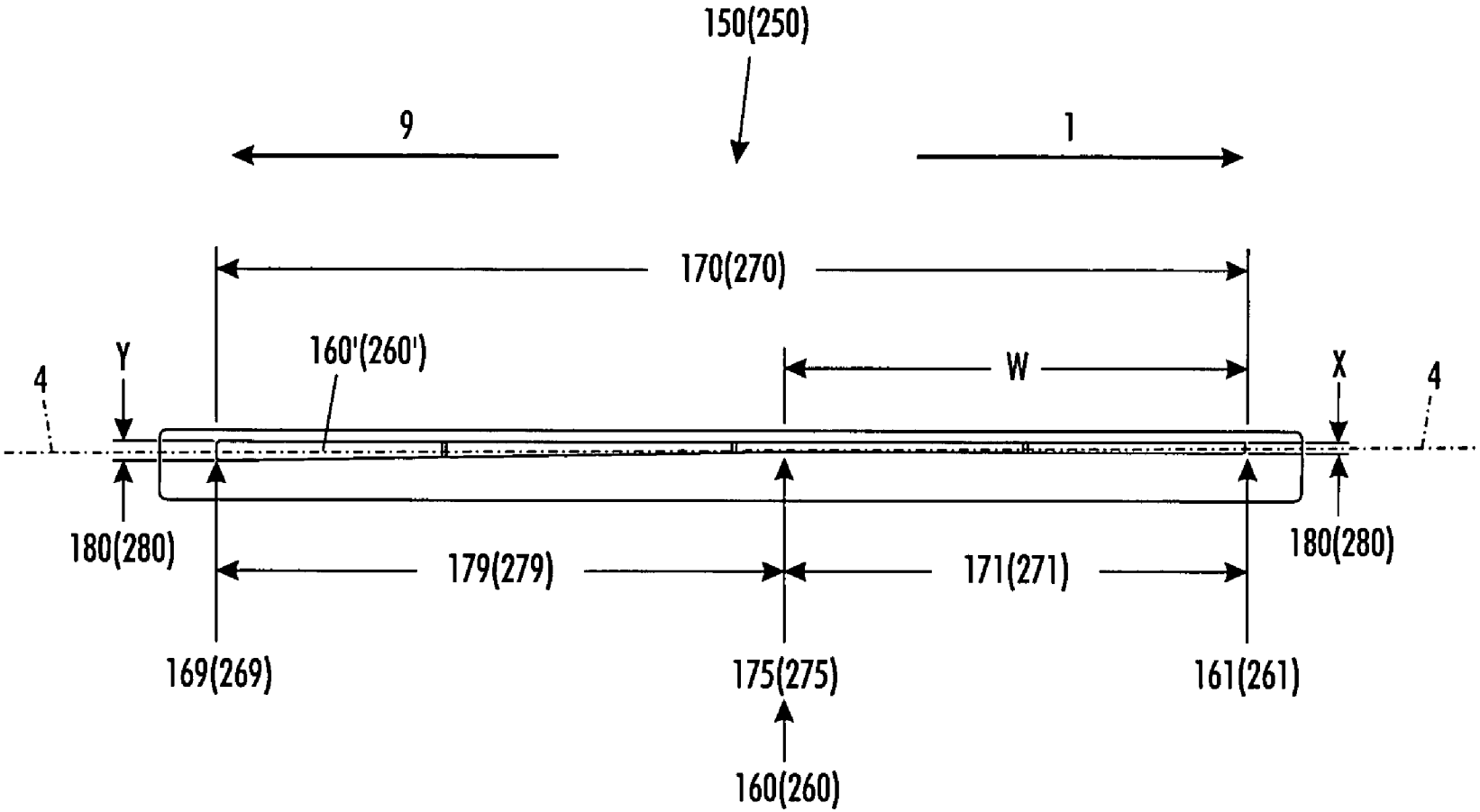
FIG. 4 is a top-down "bird's eye" view of the FIG. 3 first and second particle removal devices 150 and 250 along the reference line 4.

Still referring to FIG. 1, with reference to the first particle removal device 100, this device 100 may be embodied in any of a plurality of embodiments. For example, in one embodiment the FIG. 1 device 100 comprises the first particle removal device 110 with an integral first vacuum port 120 as depicted in FIG. 2. Also, in another embodiment the FIG. 1 device 100 comprises the first particle removal device 150 with an integral first vacuum port 160 as depicted in FIGS. 3 and 4.

Still referring to FIG. 1, with reference to the second particle removal device 200, this device 200 likewise may be embodied in any of a plurality of embodiments. For example, in one embodiment the FIG. 1 device 200 comprises the second particle removal device 210 with an integral second vacuum port 220 as depicted in FIG. 2. Also, in another embodiment the FIG. 1 device 200 comprises the second particle removal device 250 with an integral second vacuum port 260 as depicted in FIGS. 3 and 4.

Also shown in FIG. 1 are four (4) imaging drum radials radiating from the imaging drum axial 11 and respectively depicted by reference numbers 301 through 304.

Referring still to FIG. 1, with reference to the first particle removal device 100, the integral first vacuum port 120, 160 is positioned proximate to the imaging drum surface 16. Further, the first particle removal device 100 is arranged to couple to a vacuum source, thus providing a corresponding first air flow 91. As shown in FIG. 1, the first particle removal device 100 is coupled 101 to the depicted vacuum source 190. In one embodiment, the coupling 101 comprises an air duct and the vacuum source 190 comprises a blower or fan.

Referring still to FIG. 1, with reference to the second particle removal device 200, the integral second vacuum port 220, 260 is positioned proximate to the imaging drum surface 16. Further, the second particle removal device 200 is arranged to couple to a vacuum source, thus providing a corresponding second air flow 92. As shown in FIG. 1, the second particle removal device 200 is coupled 201 to the depicted vacuum source 290. In one embodiment, the coupling 201 comprises an air duct and the vacuum source 290 comprises a blower or fan.

Still referring to FIG. 1, in one embodiment the first and second particle removal devices 100 and 200 are respectively coupled to the vacuum sources 190 and 290 to provide the respective first and second air flows 91 and 92.

Referring still to FIG. 1, in one embodiment the first and second particle removal devices 100 and 200 are coupled exclusively to the vacuum source 190 to provide the respective first and second air flows 91 and 92.

Still referring to FIG. 1, in one embodiment the first and second particle removal devices 100 and 200 are coupled exclusively to the vacuum source 290 to provide the respective first and second air flows 91 and 92.

Referring still to FIG. 1, in one embodiment the first and second particle removal devices 100 and 200 themselves are both jointly coupled to both vacuum sources 190 and 290 to provide the respective first and second air flows 91 and 92.

Referring generally to FIG. 1, in summary, each of the first and second particle removal devices 100 and 200 is respectively coupled 101 and 201 to a vacuum source comprising any of the vacuum source 190 and the vacuum source 290, thus providing the respective first and second air flows 91 and 92.

In one embodiment, the two (2) depicted vacuum sources 190 and 290 comprise a plurality of vacuum sources, thus at least two (2) vacuum sources.

In another embodiment, the two (2) depicted vacuum sources 190 and 290 comprise only one (1) vacuum source. For good understanding, in this latter embodiment the depicted vacuum sources 190 and 290 comprise the identical element or apparatus. Thus, in this embodiment, the terms "vacuum source 190" and "vacuum source 290" both refer to the same component, part or item.

Still referring to FIG. 1, in one embodiment the first particle removal device 100 is positioned just downstream of the image transfer site or transfix site 0. For good understanding, the "downstream" direction is the same direction as the depicted rotational direction 19 of the imaging drum 10. The first particle removal device 100 is positioned such that the imaging drum 10 rotates a first angular amount or first angle 51 from the image transfer site 0 to the integral first vacuum port 120, 160.

With reference to the first particle removal device 100, in one embodiment the integral first vacuum port 120,160 is positioned as close as possible to the image transfer site 0, thereby minimizing the first angle 51.

Also as shown, in one embodiment the second particle removal device 200 is positioned just upstream of the one or more marking material dispensers or ink jet print heads 70. For good understanding, the "upstream" direction is opposite to the depicted rotational direction 19 of the imaging drum 10. The second particle removal device 200 is positioned such that the imaging drum rotates 10 a second angular amount or second angle 52 from the integral second vacuum port 220, 260 to the one or more marking material dispensers 70.

With reference to the second particle removal device 200, in one embodiment the integral second vacuum port 220, 260 is positioned as close as possible to the one or more marking material dispensers 70, thereby minimizing the second angle 52.

Referring still to FIG. 1, as described above, the depicted image disposing and transferring arrangement 300 comprises plural particle removal devices.

In one embodiment, the plural particle removal devices comprise exactly two (2) particle removal devices, namely, the depicted first and second particle removal devices 100 and 200. Hence, in this embodiment as an arbitrary point on the imaging drum surface 16 angularly transits, moves, travels or rotates about the imaging drum radial 11 in a circular path or trajectory fixed by the imaging drum radius 18 from the image transfer site 0 to the marking dispenser leading edge 79, the point encounters exactly and only two (2) particle removal devices, namely, the depicted first and second particle removal devices 100 and 200.

In another embodiment, the plural particle removal devices comprise more than two (2) particle removal devices. In this latter embodiment, the image disposing and transferring arrangement 300 comprises a plurality ("N") of particle removal devices, where "N" is an integer greater than 2, such as 3, 4, 5, 6, 7, etc. Hence, in this latter embodiment as an arbitrary point on the imaging drum surface 16 angularly transits, moves, travels or rotates about the imaging drum radial 11 in a circular path or trajectory fixed by the imaging drum radius 18 from the image transfer site 0 to the marking dispenser leading edge 79, the point encounters more and greater than two (2) particle removal devices, namely, at least one and perhaps a plurality of particle removal devices separate and distinct from, and in addition to, the depicted first and second particle removal devices 100 and 200.

As shown in FIG. 1, in one embodiment the one or more marking material dispensers 70 dispense a marking material comprising ink, where the ink itself comprises any form of matter, namely, any of solid, liquid and gas. In this embodiment the disposing of ink by the one or more marking material dispensers 70 is depicted in FIG. 1 by the reference numbers 81 and 82.

In another embodiment, the one or more marking material dispensers 70 dispense a marking material that is other than and different from ink.

Referring now to FIG. 2, there is depicted the image disposing and transferring arrangement 300.

As shown, in one embodiment the arrangement 300 comprises the first and second particle removal devices 110 and 210, where the devices 110 and 210 themselves are substantially as shown in FIG. 2.

Also as shown, in another embodiment the arrangement 300 comprises the first and second particle removal devices 150 and 250, where the devices 150 and 250 themselves are depicted in FIGS. 3 and 4.

Referring still to FIG. 2, now the first and second particle removal devices 110 and 210 are described.

As shown in FIG. 2, the first particle removal device 110 includes a first vacuum port 120. The first vacuum port 120, in turn, includes a first vacuum port center 120', a first vacuum port length 130 and a first vacuum port width 140.

Still referring to FIG. 2, in one embodiment the first vacuum port 120 forms the depicted first elongated slot 120. The first slot 120, in turn, includes an inboard end 121, an outboard end 129, with a slot length 130 therebetween. The first slot 120 further comprises a slot width 140. As shown, the slot length 130 extends generally parallel to the imaging drum axial 11.

With reference to the slot width 140, in one embodiment the corresponding slot width 140 value is substantially constant or uniform from the first slot inboard end 121 to the first slot outboard end 129.

With further reference to the slot width 140, in one embodiment the corresponding slot width 140 value is substantially non-constant or non-uniform from the first slot inboard end 121 to the first slot outboard end 129.

For good understanding, in FIG. 2 the first vacuum port 120 and the first slot 120 comprise the identical element or apparatus. Thus the terms "first vacuum port 120" and "first slot 120" both refer to the same component, part or item.

Still referring to the first vacuum port 120, in another embodiment the first vacuum port 120 comprises a plurality of holes disposed along the first vacuum port length 130. In this latter embodiment, the first vacuum port 120 is substantially similar to the vacuum port 31 in the foregoing U.S. Pat. No. 6,070,026 to Alfred J. Clafflin, Jr. ("Clafflin"), which patent is incorporated by reference hereinabove. Referring to the Clafflin patent, his vacuum port 31 is described from col. 2, line 66 to col. 3, line 1 in the patent text and depicted in FIGS. 1 and 3 in the patent drawing.

In a first variation of the first vacuum port 120 "Clafflin-type" embodiment described immediately above, a plurality of holes with substantially circular shapes are disposed along the first vacuum port length 130.

In a second variation of the first vacuum port 120 Clafflin-type embodiment, a plurality of holes with substantially non-circular shapes are disposed along the first vacuum port length 130.

In a third variation of the first vacuum port 120 Clafflin-type embodiment, a plurality of holes with substantially uniform or similar shapes are disposed along the first vacuum port length 130.

In a fourth variation of the first vacuum port 120 Clafflin-type embodiment, a plurality of holes with substantially non-uniform or non-similar shapes are disposed along the first vacuum port length 130.

In a fifth variation of the first vacuum port 120 Clafflin-type embodiment, a plurality of holes with substantially uniform or similar sizes or dimensions are disposed along the first vacuum port length 130.

In a sixth variation of the first vacuum port 120 Clafflin-type embodiment, a plurality of holes with substantially non-uniform or non-similar sizes or dimensions are disposed along the first vacuum port length 130.

In a seventh variation of the first vacuum port 120 Clafflin-type embodiment, a plurality of holes are disposed at substantially uniform or constant intervals along the first vacuum port length 130.

In an eighth variation of the first vacuum port 120 Clafflin-type embodiment, a plurality of holes are disposed at substantially non-uniform or non-constant intervals along the first vacuum port length 130.

In a ninth variation of the first vacuum port 120 Clafflin-type embodiment, a plurality of holes are disposed along the first vacuum port length 130 to form a substantially uniform or constant pattern.

In a tenth variation of the first vacuum port 120 Clafflin-type embodiment, a plurality of holes are disposed along the first vacuum port length 130 to form a substantially non-uniform or non-constant pattern.

In an eleventh variation of the first vacuum port 120 Clafflin-type embodiment, a plurality of holes are disposed along the first vacuum port length 130 and across the first vacuum port width 140 to form a substantially uniform or constant pattern.

In a twelfth variation of the first vacuum port 120 Clafflin-type embodiment, a plurality of holes are disposed along the first vacuum port length 130 and across the first vacuum port width 140 to form a substantially non-uniform or non-constant pattern.

Still referring to FIG. 2, as depicted therein, the second particle removal device 210 includes a second vacuum port 220. The second vacuum port 220, in turn, includes a second vacuum port center 220', a second vacuum port length 230 and a second vacuum port width 240.

As shown in FIG. 2, in one embodiment the second vacuum port 220 forms the depicted second elongated slot 220. The second slot 220, in turn, includes an inboard end 221, an outboard end 229, with a slot length 230 therebetween. The second slot 220 also comprises a slot width 240. As shown, the slot length 230 extends generally parallel to the imaging drum axial 11.

With reference to the slot width 240, in one embodiment the corresponding slot width 240 value is substantially constant or uniform from the second slot inboard end 221 to the second slot outboard end 229.

With further reference to the slot width 240, in one embodiment the corresponding slot width 240 value is substantially non-constant or non-uniform from the second slot inboard end 221 to the second slot outboard end 229.

For good understanding, in FIG. 2 the second vacuum port 220 and the second slot 220 comprise the identical element or apparatus. Thus the terms "second vacuum port 220" and "second slot 220" both refer to the same component, part or item.

Still referring to the second vacuum port 220, in another embodiment the second vacuum port 220 comprises a plurality of holes disposed along the second vacuum port length 230. In this latter "Clafflin-type" embodiment the second vacuum port 220 thus is similar to the vacuum port 31 of the Clafflin patent as described above in connection with the first vacuum port 120.

In a first variation of the second vacuum port 220 "Clafflin-type" embodiment described immediately above, a plurality of holes with substantially circular shapes are disposed along the second vacuum port length 230.

In a second variation of the second vacuum port 220 Clafflin-type embodiment, a plurality of holes with substantially non-circular shapes are disposed along the second vacuum port length 230.

In a third variation of the second vacuum port 220 Clafflin-type embodiment, a plurality of holes with substantially uniform or similar shapes are disposed along the second vacuum port length 230.

In a fourth variation of the second vacuum port 220 Clafflin-type embodiment, a plurality of holes with substantially non-uniform or non-similar shapes are disposed along the second vacuum port length 230.

In a fifth variation of the second vacuum port 220 Clafflin-type embodiment, a plurality of holes with substantially uniform or similar sizes or dimensions are disposed along the second vacuum port length 230.

In a sixth variation of the second vacuum port 220 Clafflin-type embodiment, a plurality of holes with substantially non-uniform or non-similar sizes or dimensions are disposed along the second vacuum port length 230.

In a seventh variation of the second vacuum port 220 Clafflin-type embodiment, a plurality of holes are disposed at substantially uniform or constant intervals along the second vacuum port length 230.

In an eighth variation of the second vacuum port 220 Clafflin-type embodiment, a plurality of holes are disposed at substantially non-uniform or non-constant intervals along the second vacuum port length 230.

In a ninth variation of the second vacuum port 220 Clafflin-type embodiment, a plurality of holes are disposed along the second vacuum port length 230 to form a substantially uniform or constant pattern.

In a tenth variation of the second vacuum port 220 Clafflin-type embodiment, a plurality of holes are disposed along the second vacuum port length 230 to form a substantially non-uniform or non-constant pattern.

In an eleventh variation of the second vacuum port 220 Clafflin-type embodiment, a plurality of holes are disposed along the second vacuum port length 230 and across the second vacuum port width 240 to form a substantially uniform or constant pattern.

In a twelfth variation of the second vacuum port 220 Clafflin-type embodiment, a plurality of holes are disposed along the second vacuum port length 230 and across the second vacuum port width 240 to form a substantially non-uniform or non-constant pattern.

Now referring generally to the first and second particle removal devices 110 and 210, in one embodiment the integral first and second vacuum ports 120 and 220 include respective shapes and sizes that are substantially identical.

Still referring to FIG. 2, with reference to the first particle removal device 110, the integral first vacuum port 120 is proximate to the imaging drum surface 16. Further, the first vacuum port 120 is positioned with respect to the image transfer site 0 such that the imaging drum 10 angularly moves, transits or rotates 19 a first angular amount or angle 51 from the image transfer site 0 to the first vacuum port 120. The first angle 51 is formed by the imaging drum radials 301 and 302, where the imaging drum radial 301 intersects the image transfer site 0 transfix roller axial 61 and the imaging drum radial 302 intersects the first vacuum port center 120'.

As shown in FIG. 2, in one embodiment the first vacuum port 120 is positioned as close as possible to the image transfer site 0, thereby minimizing the first angle 51.

Referring still to FIG. 2, the one or more marking material dispensers 70 form a marking dispenser leading edge 79 that is nearest or closest to the second vacuum port 220. With reference to the second particle removal device 210, the integral second vacuum port 220 is positioned proximate to the imaging drum surface 16. Further, the second vacuum port 220 is positioned with respect to the one or more marking material dispensers 70 such that the imaging drum 10 angularly moves, transits or rotates 19 a second angular amount or angle 52 from the second vacuum port 220 to the one or more marking material dispensers 70. The second angle 52 is formed by the imaging drum radials 303 and 304, where the imaging drum radial 303 intersects the second vacuum port center 220' and the imaging drum radial 304 intersects the marking dispenser leading edge 79.

In one embodiment, the second vacuum port 220 is positioned as close as possible to the marking dispenser leading edge 79, thereby minimizing the second angle 52.

Referring still to FIG. 2 and now also cross-referring to FIGS. 3 and 4, the first and second particle removal devices 150 and 250 now are described.

The first particle removal device reference number 150 is shown inside parenthesis symbols in FIG. 2, and the second particle removal device reference number 250 is shown inside parenthesis symbols in FIGS. 2, 3 and 4.

As shown in FIGS. 2, 3 and 4, the first particle removal device 150 includes a first vacuum port 160. The first vacuum port 160, in turn, includes a first vacuum port center 160'.

The first vacuum port 160 forms a first elongated slot 160 including an inboard end 161, an outboard end 169, with a slot length 170 extending generally parallel to the imaging drum axial 11. The first slot 160 further comprises a slot width 180.

In FIG. 2 the foregoing reference numbers 160, 160', 161, 169, 170 and 180 are shown inside parenthesis symbols.

Referring still to FIGS. 2, 3 and 4, the second particle removal device 250 includes a second vacuum port 260. The second vacuum port 260, in turn, includes a second vacuum port center 260'.

The second vacuum port 260 forms a second elongated slot 260 including an inboard end 261, an outboard end 269, with a slot length 270 extending generally parallel to the imaging drum axial 11. The second slot 260 further comprises a slot width 280.

The foregoing reference numbers 260, 260', 261, 269 and 270 are shown inside parenthesis symbols in FIGS. 2, 3 and 4. Also, the reference number 280 is shown inside parenthesis symbols in FIGS. 2 and 4.

In one embodiment, the first and second vacuum ports 160 and 260 include respective shapes and sizes that are substantially identical.

Still referring to FIGS. 2, 3 and 4, with reference to the first particle removal device 150, the integral first vacuum port 160 is positioned proximate to the imaging drum surface 16. Further, the first vacuum port 160 is positioned with respect to the image transfer site 0 such that the imaging drum 10 angularly moves, transits or rotates 19 a first angle 51 from the image transfer site 0 to the first vacuum port 160. The first angle 51 is formed by the imaging drum radials 301 and 302, where the imaging drum radial 302 intersects the first vacuum port center 160'.

In one embodiment, the first vacuum port 160 is positioned as close as possible to the image transfer site 0, thereby minimizing the first angle 51.

Referring still to FIGS. 2, 3 and 4, the one or more marking material dispensers 70 form a marking dispenser leading edge 79 that is nearest or closest to the second vacuum port 260. With reference to the second particle removal device 250, the integral second vacuum port 260 is positioned proximate to the imaging drum surface 16. Further, the second vacuum port 260 is positioned with respect to the one or more marking material dispensers 70 such that the imaging drum 10 angularly moves, transits or rotates 19 a second angle 52 from the second vacuum port 260 to the one or more marking material dispensers 70. The second angle 52 is formed by the imaging drum radials 303 and 304, where the imaging drum radial 303 intersects the second vacuum port center 260' and the imaging drum radial 304 intersects the marking dispenser leading edge 79.

In one embodiment, the second vacuum port 260 is positioned as close as possible to the marking dispenser leading edge 79, thereby minimizing the second angle 52.

Referring now generally to the latter two drawing views FIGS. 3 and 4, there is depicted the first particle removal device 150, the second particle removal device 250 and the reference line 4. As shown, the first and second particle removal devices 150 and 250 include the integral first and second vacuum ports 160 and 260.

For good understanding, the first vacuum port 160 and the first slot 160 comprise the identical element or apparatus. Thus the terms "first vacuum port 160" and "first slot 160" both refer to the same component, part or item.

Likewise, the second vacuum port 260 and the second slot 260 comprise the identical element or apparatus. Thus the terms "second vacuum port 260" and "second slot 260" both refer to the same component, part or item.

As shown in FIGS. 3 and 4, in one embodiment the first and second vacuum ports or slots 160 and 260 include respective shapes and sizes that are substantially identical.

Also as shown in FIGS. 3 and 4, in one embodiment the first and second particle removal devices 150 and 250 comprise vacuum plenums or manifolds with the respective integral first and second slots 160 and 260 comprising slit orifices.

Still referring to FIGS. 3 and 4, with reference to the first vacuum port 160, the depicted reference line 4 is coincident with the first vacuum port center 160'.

Still referring to FIGS. 3 and 4, with reference to the second vacuum port 260, the depicted reference line 4 is coincident with the second vacuum port center 260'.

Referring now to FIG. 4, there is a top-down "bird's eye" view of the first and second particle removal devices 150 and 250 along the reference line 4.

As shown in FIG. 4, with reference to the first particle removal device 150 and its integral first slot 160, the first slot 160 comprises the first slot length 170 and first slot width 180. The first slot width 180, in turn, comprises a first slot width outboard value (reference letter "Y") at the first slot outboard end 169 and a smaller first slot width inboard value (reference letter "X") at the first slot inboard end 161.

Still referring to FIG. 4, in one embodiment the first slot 160 includes a first slot constant-width portion 171 and a first slot tapered-width portion 179.

Referring to the first slot constant-width portion 171, as depicted, the first slot 160 is shaped such that the first slot width value 180 is substantially constant or uniform from the first slot inboard end 161 to a first slot width-transition point 175 located a first slot constant-width portion length (reference letter "W") from the first slot inboard end 161 in the direction towards the first slot outboard end 169.

Referring now to the first slot tapered-width portion 179, as shown, the first slot 160 is shaped such that the first slot width value 180 gradually increases from the first slot width-transition point 175 to the first slot outboard end 169.

Referring still to the first slot 160, in one embodiment the first slot length value 170 is about 335 milli-Meters ("mm"), the first slot width 180 inboard value (X) at the first slot inboard end 161 is about 3.17 mm, the first slot width 180 outboard value (Y) at the first slot outboard end 169 is about 6.33 mm, and the first slot constant-width portion length value (W) is about 150 mm.

As further shown in FIG. 4, with reference now to the second particle removal device 250 and its integral second slot 260, the second slot 260 comprises the depicted second slot length 270 and second slot width 280. The second slot width 280, in turn, comprises a second slot width outboard value (Y) at the second slot outboard end 269 and a smaller second slot width inboard value (X) at the second slot inboard end 261.

Still referring to FIG. 4, in one embodiment the second slot 260 includes a second slot constant-width portion 271 and a second slot tapered-width portion 279.

In FIG. 4 the foregoing reference numbers 271 and 279 are shown inside parenthesis symbols.

Referring to the second slot constant-width portion 271, as depicted in FIG. 4, the second slot 260 is shaped such that the second slot width value 280 is substantially constant or uniform from the second slot inboard end 261 to a second slot width-transition point 275 located a second slot constant-width portion length (W) from the second slot inboard end 261 in the direction towards the second slot outboard end 269.

In FIG. 4 the foregoing reference number 275 is shown inside parenthesis symbols.

Referring now to the second slot tapered-width portion 279, as shown, the second slot 260 is shaped such that the second slot width value 280 gradually increases from the second slot width-transition point 275 to the second slot outboard end 269.

Referring still to the second slot 260, in one embodiment the second slot length value 270 is about 335 mm, the second slot width 280 inboard value (X) at the second slot inboard end 261 is about 3.17 mm, the second slot width 280 outboard value (Y) at the second slot outboard end 269, is about 6.33 mm, and the second slot constant-width portion length value (W) is about 150 mm.

In summary, plural particle removal devices 100 and 200 are arranged to vacuum clean the image drum 10. The plural particle removal devices 100 and 200 act to reduce or remove particle contaminates from the drum surface 16 and from the entrained air boundary layer, thus reducing the contamination flux to the print head aperture plate. In turn, the number of ink jet failures is reduced, thereby increasing reliability of the printer 400.

Further, in one embodiment, the plural particle removal devices form a dual-site particle abatement system. In one embodiment, the dual-site particle abatement system comprises plural vacuum plenums or manifolds with slit orifices are placed in close proximity to the drum 10. Sufficient vacuum is applied to the plural plenums such that a shear force is developed at the surface of the drum which is sufficient to dislodge contaminates adhering to the drum. Once dislodged, the contamination is captured by the plural vacuum air flows and redirected away from the printhead, where it is most likely to cause printhead failures. In addition to collecting contaminants adhered to the drum, the plural vacuum plenums also collect airborne contamination particles that are entrained in the boundary layer surrounding the drum.

Moreover, in one embodiment, the dual-site particle abatement system comprises plural vacuum plenums or manifolds, connecting ducts, and one or more blowers to generate the vacuum airflows. In one embodiment, this system cleans the intermediate image drum surface and the surrounding entrained air layer in a typical solid ink printing architecture.

Hence, the dual-site vacuum abatement concept as described herein is applied to ink jet technologies where the problem of dust contamination can be catastrophic, and is a major driver of print head reliability.

Referring generally to FIG. 1, the underlying rationale or basis for placing the two (2) plural particle removal devices 100 and 200 in two (2) respectively separate, distinct and different locations is now discussed.

As shown in FIG. 1, the dual-site particle abatement system depicted therein comprises a first particle abatement site generally depicted by reference number 100 and a second particle abatement site generally depicted by reference number 200. The purpose of the first particle abatement site 100 is to collect paper debris that results from the image transfer operation at the image transfer site 0, so this is the site of contamination. The purpose of the second particle abatement site 200 is to clean the imaging drum 10 and the entrained air layer just before it encounters the sensitive image disposing site 70, namely, the ink jet nozzle plate. Thus, the dual particle abatement sites 100 and 200 collect the contamination both at the site of contamination, namely, the image transfer site 0, and also at the area sensitive to contamination, namely, the image disposing site 70, comprising the ink jet nozzle plate.

A new experimental technique was created to measure the number and size distribution of contaminant particles that migrate and accumulate on the print head aperture plate. This particle collection and analysis technique was used in solid ink printers to characterize the contaminant flux to the print head under control conditions (no abatement) and also with vacuum abatement operating at different levels of airflow. The results very clearly indicate that, given ample air flow such as, for example, from 5 to 8 cubic feet of air flow per minute ("cfm"), the use of vacuum abatement significantly reduces the contaminant flux to the front face of the printhead.

Furthermore, it has been proven that there is a direct correlation between the amount of particle contamination at the printhead and the printhead failure rate. Moreover, it has been proven that by controlling the particle contamination levels found at the printhead with vacuum abatement, print head reliability can be significantly improved.

In one embodiment, each particle removal device 100 and 200 in the dual-site particle abatement system uses an airflow (91 and 92) of 8 cfm, with a spacing between the drum surface 16 and the vacuum port orifice (41 and 42) of 0.040 inches.

In one embodiment, the abatement data for printers equipped with the dual-site particle abatement system indicates a 38 per-cent (%) reduction in IWM rate when compared to the control group without abatement.

Moreover, in one embodiment of the dual-site particle abatement system, the second particle removal device 200 is placed just upstream of the print heads 70 while the first particle removal device 100 is placed just downstream of the source of the paper particle contamination, that is, just downstream of the transfix site 0. The concept is to vacuum clean the paper dust just after it is introduced to the drum area. The goal is to capture most of the contamination before it has a chance to spread downstream on the drum or before it is thrown off either into the entrained boundary later or into the general environment of the print area. The second particle removal device 200 remains just upstream of the particle-sensitive print heads 70 and serves as a last line of defense for the nozzle faces.

In one embodiment, the dual-site particle abatement system is optimized for a specific location. For example, in one embodiment the first particle removal device 100 near the transfix site 0 utilizes a high-volume but moderate air pressure to engulf the paper particulate from a large area whereas the second particle removal device 200 near the printheads 70 is a low-volume, very low air pressure system that only pulls air locally near the printheads 70.

In another embodiment, types of abatement are mixed, for example, vacuum abatement at the transfix site 0 but sticky baffles that getter particles from the boundary layer in which the print head is immersed.

Thus, there has been described the first aspect of the invention, namely, an image forming device 400 including an imaging drum 10 and one or more marking material dispensers 70 arranged for forming a disposed image 2 on an included imaging drum surface 16, the imaging drum 10 arranged to transfer the disposed image 2 to a media or paper 5 at an image transfer site 0, the image forming device 400 including plural particle removal devices comprising at least a first particle removal device 100, 110, 150 and a second particle removal device 200, 210, 250, the first particle removal device 100 including a first vacuum port 120,160 positioned such that the imaging drum 10 rotates 19 a first angle 51 from the image transfer site 0 to the first vacuum port 120, 160, the second particle removal device 200 including a second vacuum port 220, 260 positioned such that the imaging drum 10 rotates 19 a second angle 52 from the second vacuum port 220, 260 to the one or more marking material dispensers 70.

The following forty-five (45) sentences A-S1 apply to the foregoing first aspect of the invention:

A. In one embodiment, the first vacuum port 120,160 is positioned as close as possible to the image transfer site 0, thereby minimizing the first angle 51.

B. In one embodiment, the second vacuum port 220, 260 is positioned as close as possible to the one or more marking material dispensers 70, thereby minimizing the second angle 52.

C. In one embodiment, the imaging drum 10 comprises a transfix drum.

D. In one embodiment, the one or more marking material dispensers 70 comprise one or more ink jet print heads.

E. In one embodiment, the first vacuum port 120 comprises a plurality of holes with substantially circular shapes disposed along an included first vacuum port length 130.

F. In one embodiment, the first vacuum port 120 comprises a plurality of holes with substantially non-circular shapes disposed along an included first vacuum port length 130.

G. In one embodiment, the first vacuum port 120 comprises a plurality of holes with substantially uniform or similar shapes disposed along an included first vacuum port length 130.

H. In one embodiment, the first vacuum port 120 comprises a plurality of holes with substantially non-uniform or non-similar shapes disposed along an included first vacuum port length 130.

I. In one embodiment, the first vacuum port 120 comprises a plurality of holes with substantially uniform or similar sizes or dimensions disposed along an included first vacuum port length 130.

J. In one embodiment, the first vacuum port 120 comprises a plurality of holes with substantially non-uniform or non-similar sizes or dimensions disposed along an included first vacuum port length 130.

K. In one embodiment, the first vacuum port 120 comprises a plurality of holes disposed at substantially uniform or constant intervals along an included first vacuum port length 130.

L. In one embodiment, the first vacuum port 120 comprises a plurality of holes disposed at substantially non-uniform or non-constant intervals along an included first vacuum port length 130.

M. In one embodiment, the first vacuum port 120 comprises a plurality of holes disposed along an included first vacuum port length 130 to form a substantially uniform or constant pattern.

N. In one embodiment, the first vacuum port 120 comprises a plurality of holes disposed along an included first vacuum port length 130 to form a substantially non-uniform or non-constant pattern.

O. In one embodiment, the first vacuum port 120 comprises a plurality of holes disposed along an included first vacuum port length 130 and across an included first vacuum port width 140 to form a substantially uniform or constant pattern.

P. In one embodiment, the first vacuum port 120 comprises a plurality of holes disposed along an included first vacuum port length 130 and across an included first vacuum port width 140 to form a substantially non-uniform or non-constant pattern.

Q. In one embodiment, the first vacuum port 120, 160 forms a first elongated slot 120, 160 comprising a first slot length 130, 170 extending generally parallel to an included imaging drum axial 11.

R. In one embodiment, the first slot 120 comprises a slot width 140 where the corresponding slot width 140 value is substantially constant or uniform from an included first slot inboard end 121 to an included first slot outboard end 129.

S. In one embodiment, the first slot 120 comprises a slot width 140 where the corresponding slot width 140 value is substantially non-constant or non-uniform from an included first slot inboard end 121 to an included first slot outboard end 129.

T. In one embodiment, the first slot 160 includes a first slot width 180, where the first slot width 180 comprises a first slot width outboard value at an included first slot outboard end 169 and an equal or smaller first slot width inboard value at an included first slot inboard end 161.

U. In one embodiment, the first slot width 180 value is substantially constant or uniform from the first slot inboard end 161 to a first slot width-transition point 175 located a first slot constant-width portion length from the first slot inboard end 161 towards the first slot outboard end 169, the first slot width 180 value gradually increasing from the first slot width-transition point 175 to the first slot outboard end 169.

V. In one embodiment, the first slot length 170 is about 335 mm, the first slot width 180 inboard value at the first slot inboard end 161 is about 3.17 mm, the first slot width 180 outboard value at the first slot outboard end 169 is about 6.33 mm, and the first slot constant-width portion length value is about 150 mm.

W. In one embodiment, the second vacuum port 220 comprises a plurality of holes with substantially circular shapes disposed along an included second vacuum port length 230.

X. In one embodiment, the second vacuum port 220 comprises a plurality of holes with substantially non-circular shapes disposed along an included second vacuum port length 230.

Y. In one embodiment, the second vacuum port 220 comprises a plurality of holes with substantially uniform or similar shapes disposed along an included second vacuum port length 230.

Z. In one embodiment, the second vacuum port 220 comprises a plurality of holes with substantially non-uniform or non-similar shapes disposed along an included second vacuum port length 230.

A1. In one embodiment, the second vacuum port 220 comprises a plurality of holes with substantially uniform or similar sizes or dimensions disposed along an included second vacuum port length 230.

B1. In one embodiment, the second vacuum port 220 comprises a plurality of holes with substantially non-uniform or non-similar sizes or dimensions disposed along an included second vacuum port length 230.

C1. In one embodiment, the second vacuum port 220 comprises a plurality of holes disposed at substantially uniform or constant intervals along an included second vacuum port length 230.

D1. In one embodiment, the second vacuum port 220 comprises a plurality of holes disposed at substantially non-uniform or non-constant intervals along an included second vacuum port length 230.

E1. In one embodiment, the second vacuum port 220 comprises a plurality of holes disposed along an included second vacuum port length 230 to form a substantially uniform or constant pattern.

F1. In one embodiment, the second vacuum port 220 comprises a plurality of holes disposed along an included second vacuum port length 230 to form a substantially non-uniform or non-constant pattern.

G1. In one embodiment, the second vacuum port 220 comprises a plurality of holes disposed along an included second vacuum port length 230 and across an included second vacuum port width 240 to form a substantially uniform or constant pattern.

H1. In one embodiment, the second vacuum port 220 comprises a plurality of holes disposed along an included second vacuum port length 230 and across an included second vacuum port width 240 to form a substantially non-uniform or non-constant pattern.

I1. In one embodiment, the second vacuum port 220, 260 forms a second elongated slot 220, 260 comprising a second slot length 230, 270 extending generally parallel to an included imaging drum axial 11.

J1. In one embodiment, the second slot 220 comprises a slot width 240 where the corresponding slot width 240 value is substantially constant or uniform from an included second slot inboard end 221 to an included second slot outboard end 229.

K1. In one embodiment, the second slot 220 comprises a slot width 240 where the corresponding slot width 240 value is substantially non-constant or non-uniform from an included second slot inboard end 221 to an included second slot outboard end 229.

L1. In one embodiment, the second slot 260 includes a second slot width 280, where the second slot width 280 comprises a second slot width outboard value at an included second slot outboard end 269 and an equal or smaller second slot width inboard value at an included second slot inboard end 261.

M1. In one embodiment, the second slot width 280 value is substantially constant or uniform from the second slot inboard end 261 to a second slot width-transition point 275 located a second slot constant-width portion length from the second slot inboard end 261 towards the second slot outboard end 269, the second slot width 280 value gradually increasing from the second slot width-transition point 275 to the second slot outboard end 269.

N1. In one embodiment, the second slot length 270 is about 335 mm, the second slot width 280 inboard value at the second slot inboard end 261 is about 3.17 mm, the second slot width 280 outboard value at the second slot outboard end 269 is about 6.33 mm, and the second slot constant-width portion length value is about 150 mm.

O1. In one embodiment, the first particle removal device 100, 110, 150 and the second particle removal device 200, 210, 250 are arranged to couple 101 and 201 to a vacuum source (namely, at least one vacuum source of vacuum source 190 and vacuum source 290); the first vacuum port 120, 160 thus providing a first air flow 91 and the second vacuum port 220, 260 thus providing a second air flow 92.

P1. In one embodiment, the plural particle removal devices comprises exactly two (2) particle removal devices 100 and 200.

Q1. In one embodiment, the image transfer site 0 comprises a transfix site.

R1. In one embodiment, the marking material comprises ink.

S1. In one embodiment, the image forming device 400 comprises a printing machine or printer.

Also, there has been described the second aspect of the invention, namely, an image forming device 400 including an imaging drum 10 and one or more marking material dispensers 70 arranged for forming a disposed image 2 on an included imaging drum surface 16, the imaging drum 10 arranged to transfer the disposed image 2 to a media or paper 5 at an image transfer site 0, the image forming device 400 including plural particle removal devices comprising at least a first particle removal device 110, 150 and a second particle removal device 210, 250, the first particle removal device 110, 150 including a first elongated slot 120, 160 positioned such that the imaging drum 10 rotates a first angle 51 from the image transfer site 0 to the first slot 120,160, the second particle removal device 210, 250 including a second elongated slot 220, 260 positioned such that the imaging drum 10 rotates a second angle 52, from the second slot 220, 260 to the one or more marking material dispensers 70.

The following eleven (11) sentences T1-D2 apply to the foregoing second aspect of the invention:

T1. In one embodiment, the first slot 120,160 is positioned as close as possible to the image transfer site 0, thereby minimizing the first angle 51; and the second slot 220, 260 is positioned as close as possible to the one or more marking material dispensers 70, thereby minimizing the second angle 52.

U1. In one embodiment, the imaging drum 10 comprises a transfix drum and the image transfer site 0 comprises a transfix site.

V1. In one embodiment, the first slot 160 forms a first slot length 170 and a first slot width 180, where the first slot width 180 comprises a first slot width outboard value at an included first slot outboard end 169 and an equal or smaller first slot width inboard value at an included first slot inboard end 161.

W1. In one embodiment, the first slot width 180 value is substantially constant or uniform from the first slot inboard end 161 to a first slot width-transition point 175 located a first slot constant-width portion length from the first slot inboard end 161 towards the first slot outboard end 169, the first slot value 180 value gradually increasing from the first slot width-transition point 175 to the first slot outboard end 169.

X1. In one embodiment, the first slot length 170 is about 335 mm; the first slot width 180 inboard value at the first slot inboard end 161 is about 3.17 mm; the first slot width 180 outboard value at the first slot outboard end 169 is about 6.33 mm; and the first slot constant-width portion length value is about 150 mm.

Y1. In one embodiment, the first slot 160 and the second slot 260 include respective shapes and dimensions that are substantially identical.

Z1. In one embodiment, the one or more marking material dispensers 70 comprise one or more ink jet print heads.

A2. In one embodiment, the plural particle removal devices exclusively comprise the first particle removal device 150 and the second particle removal device 250.

B2. In one embodiment, the first particle removal device 150 and the second particle removal device 250 are arranged to couple 101 and 201 to a vacuum source (namely, at least one vacuum source of vacuum source 190 and vacuum source 290) such that the first slot 160 provides a first air flow 91 and the second slot 260 provides a second air flow 92.

C2. In one embodiment, the marking material comprises ink.

D2. In one embodiment, the image forming device 400 comprises a printing machine or printer.

Further, there has been described the third aspect of the invention, namely, a printer 400 including an imaging drum 10 and one or more marking material dispensers 70 arranged for forming a disposed image 2 on an included imaging drum surface 16, the imaging drum 10 arranged to transfer the disposed image 2 to a media or paper 5 at an image transfer site 0; the printer 400 including a first particle removal device 150 and a second particle removal device 250; the first particle removal device 150 including a first elongated slot 160 positioned such that the imaging drum 10 rotates 19 a first angle 51 from the image transfer site 0 to the first slot 160, the first slot 160 positioned as close as possible to the image transfer site 0; the second particle removal device 250 including a second elongated slot 260 positioned such that the imaging drum 10 rotates 19 a second angle 52 from the second slot 260 to the one or more marking material dispensers 70, the second slot 260 positioned as close as possible to the one or more marking material dispensers 70; the first and second slots 160 and 260 having respective shapes and sizes that are substantially identical; each slot 160, 260 comprising a slot length 170, 270 extending generally parallel to an included imaging drum axial 11 and a slot width 180, 280; the slot width 180, 280 comprising a slot width outboard value at an included slot outboard end 169, 269 and a smaller slot width inboard value at an included slot inboard end 161, 261; the slot width value 180, 280 being substantially constant from the slot inboard end 161, 261 to a slot width-transition point 175, 275 located a slot constant-width portion length from the slot inboard end 161, 261 towards the slot outboard end 169, 269, the slot width value 180, 280 gradually increasing from the slot width-transition point 175, 275 to the slot outboard end 169, 269; the first particle removal device 150 coupled to a vacuum source 190 and the second particle removal device 250 coupled to a vacuum source 290; the first slot 160 positioned proximate to the imaging drum surface 16 to provide a first air flow 91 and the second slot 260 positioned proximate to the imaging drum surface 16 to provide a second air flow 92; where the marking material comprises ink.

In one embodiment of the third aspect of the invention, the imaging drum 10 comprises a transfix drum, the image transfer site 0 comprising a transfix site, the one or more marking material dispensers 70 comprising one or more ink jet print heads; the slot length 170, 270 being about 335 mm; the slot width inboard value being about 3.17 mm at the slot inboard end 161, 261; the slot width outboard value being about 6.33 mm at the slot outboard end 169, 269; and the slot constant-width portion length being about 150 mm.

The table below lists the drawing element reference numbers together with their corresponding written description:

REF. NO.: DESCRIPTION

0 image transfer site, or transfix site
1 inboard direction
2 disposed image
4 reference line
5 media or paper
8 media travel path, spanwise or downstream direction
9 outboard direction
10 imaging drum, or transfix drum
11 imaging drum axial
16 imaging drum surface
17 imaging drum length
18 imaging drum radius
19 imaging drum angular movement, transition or rotation direction
41 spacing between drum surface 16 and first vacuum ports 120,160
42 spacing between drum surface 16 and second vacuum ports 220, 260
51 first angle formed by the imaging drum radials 301 and 302
52 second angle formed by the imaging drum radials 303 and 304
60 transfix roller
61 transfix roller axial
69 transfix roller rotation
70 one or more marking material dispensers, or ink jet print heads 71, 72
71 marking material dispenser, or ink jet print head
72 marking material dispenser, or ink jet print head
79 marking dispenser leading edge
81 dispensing of marking material
82 dispensing of marking material
91 first air flow
92 second air flow
100 first particle removal device, or first particle abatement site
101 coupling from the first particle removal device 100 to a vacuum source
110 one embodiment of the first particle removal device 100
120 first vacuum port, or first slot
120' first vacuum port center, or first slot center
121 first vacuum port inboard end, or first slot inboard end
129 first vacuum port outboard end, or first slot outboard end
130 first vacuum port length, or first slot length
140 first vacuum port width, or first slot width
150 another embodiment of the first particle removal device 100
160 first vacuum port, or first slot
160' first vacuum port center, or first slot center
161 first vacuum port inboard end, or first slot inboard end
169 first vacuum port outboard end, or first slot outboard end
170 first vacuum port length, or first slot length
171 first slot constant-width portion
175 first slot width-transition point
179 first slot tapered-width portion
180 first vacuum port width, or first slot width
190 vacuum source
200 second particle removal device, or second particle abatement site
201 coupling from the second particle removal device 200 to a vacuum source

210 one embodiment of the second particle removal device 200
220 second vacuum port, or second slot
220' second vacuum port center, or second slot center
221 second vacuum port inboard end, or second slot inboard end
229 second vacuum port outboard end, or second slot outboard end
230 second vacuum port length, or second slot length
240 second vacuum port width, or second slot width
250 another embodiment of the second particle removal device 200
260 second vacuum port, or second slot
260' second vacuum port center, or second slot center
261 second vacuum port inboard end, or second slot inboard end
269 second vacuum port outboard end, or second slot outboard end
270 second vacuum port length, or second slot length
271 second slot constant-width portion
275 second slot width-transition point
279 second slot tapered-width portion
280 second vacuum port width, or second slot width
290 vacuum source
300 image disposing and transferring arrangement
301 imaging drum radial intersecting the imaging drum axial 11 and the image transfer site 0
302 imaging drum radial intersecting the imaging drum axial 11 and the first vacuum port centers 120', 160'
303 imaging drum radial intersecting the imaging drum axial 11 and the second vacuum port centers 220', 260'
304 imaging drum radial intersecting the imaging drum axial 11 and the marking dispenser leading edge 79
400 image forming device including, but not limited to, a printer While various embodiments of an image forming device arranged with plural particle removal devices, in accordance with the present invention, are described above, the scope of the invention is defined by the following claims.

What is claimed is:

1. An image forming device comprising:
an imaging drum comprising an imaging drum surface; and
one or more marking material dispensers arranged for forming a disposed image on said imaging drum surface,
said imaging drum being arranged to transfer said disposed image to a media at an image transfer site,
said image forming device comprising plural particle removal devices comprising at least a first particle removal device and a second particle removal device,
said first particle removal device comprising a first vacuum port positioned such that said imaging drum rotates a first angle from said image transfer site to the first vacuum port,
said second particle removal device comprising a second vacuum port positioned such that said imaging drum rotates a second angle from said second vacuum port to said one or more marking material dispensers,
at least one of said first vacuum port and said second vacuum port comprising
an elongated slot opening into which particles are drawn by vacuum,
said slot opening comprising a length and a width perpendicular to said length,
said slot opening comprising a first end at one extreme of said length, a second end at an opposite extreme of said length, and a width-transition point along said length between said first end and said second end,
said width of said slot opening being non-tapered and consistent from said first end to said width-transition point, and
said width of said slot opening being tapered and increasing from said width-transition point to said second end.

2. The image forming device of claim 1, said first vacuum port being positioned as close as possible to said image transfer site, thereby minimizing said first angle.

3. The image forming device of claim 1, said second vacuum port being positioned as close as possible to said one or more marking material dispensers, thereby minimizing said second angle.

4. The image forming device of claim 1, said imaging drum comprising a transfix drum.

5. The image forming device of claim 1, said one or more marking material dispensers comprising one or more ink jet print heads.

6. The image forming device of claim 1, said first particle removal device and said second particle removal device being arranged to couple to a vacuum source, said first vacuum port thus providing a first air flow and said second vacuum port thus providing a second air flow having a different air flow rate than said first air flow.

7. The image forming device of claim 1, said plural particle removal devices comprising exactly two particle removal devices.

8. The image forming device of claim 1, said image transfer site comprising a transfix site.

9. The image forming device of claim 1, said marking material comprising ink.

10. The image forming device of claim 1, said image forming device comprising a printer.

11. The device according to claim 1, said width-transition point being positioned about half-way between said first end and said second end.

12. The device according to claim 1, said width-transition point being positioned about two-fifths of said length from said first end.

13. The device according to claim 1, said width of said slot opening increasing from said width-transition point to said second end by a factor of about 2.

14. The device according to claim 1, said first end comprising an inboard end and said second end comprising an outboard end.

15. An image forming device comprising:
an imaging drum comprising an imaging drum surface;
one or more marking material dispensers arranged for forming a disposed image on
said imaging drum surface, said imaging drum being arranged to transfer said disposed image to a media at an image transfer site; and
plural particle removal devices comprising at least a first particle removal device and a second particle removal device,
said first particle removal device comprising a first elongated slot positioned such that said imaging drum rotates a first angle from said image transfer site to said first slot,
said second particle removal device comprising a second elongated slot positioned such that said imaging drum rotates a second angle from said second slot to said one or more marking material dispensers,
at least one of said first elongated slot and said second elongated slot comprising a
slot opening into which particles are drawn by vacuum,
said slot opening comprising a length and a width perpendicular to said length, said slot opening comprising a first end at one extreme of said length, a second end at an opposite extreme of said length, and a width-transition point along said length between said first end and said second end, said width of said slot opening being non-tapered and consistent from said first end to said width-transition point, and said width of said slot opening being tapered and increasing from said width-transition point to said second end.

16. The image forming device of claim 15, said first slot being positioned as close as possible to said image transfer site, thereby minimizing said first angle; and said second slot being positioned as close as possible to said one or more marking material dispensers, thereby minimizing said second angle.

17. The image forming device of claim 15, said imaging drum comprising a transfix drum and said image transfer site comprising a transfix site.

18. The image forming device of claim 15 , said first slot and said second slot comprising respective shapes and dimensions that are substantially identical.

19. The image forming device of claim 18, said one or more marking material dispensers comprising one or more ink jet print heads.

20. The image forming device of claim 18, said plural particle removal devices exclusively comprising said first particle removal device and said second particle removal device.

21. The image forming device of claim 18, said first particle removal device and said second particle removal device being arranged to couple to a vacuum source such that said first slot provides a first air flow and said second slot provides a second air flow having a different air flow rate than said first air flow.

22. The image forming device of claim 18, said marking material comprising ink.

23. The image forming device of claim 18, said image forming device comprising a printer.

24. The device according to claim 15, said width-transition point being positioned about half-way between said first end and said second end.

25. The device according to claim 15, said width-transition point being positioned about two-fifths of said length from said first end.

26. The device according to claim 15, said width of said slot opening increasing from said width-transition point to said second end by a factor of about 2.

27. The device according to claim 15, said first end comprising an inboard end and said second end comprising an outboard end.

28. A printer comprising:

an imaging drum comprising an imaging drum surface;

one or more marking material dispensers arranged for forming a disposed image on said imaging drum surface, said imaging drum being arranged to transfer said disposed image to a media at an image transfer site; and a first particle removal device and a second particle removal device, said first particle removal device comprising a first elongated slot positioned such that said imaging drum rotates a first angle from said image transfer site to said first slot, said first slot being positioned as close as possible to said image transfer site, said second particle removal device comprising a second elongated slot positioned such that said imaging drum rotates a second angle from said second slot to said one or more marking material dispensers, said second slot being positioned as close as possible to said one or more marking material dispensers, said first and second slots having respective shapes and sizes that are substantially identical, said first particle removal device being coupled to a vacuum source and said second particle removal device being coupled to a vacuum source, said first slot being positioned proximate to said imaging drum surface to provide a first air flow and said second slot being positioned proximate to said imaging drum surface to provide a second air flow having a different air flow rate than said first air flow, said marking material comprising ink, at least one of said first elongated slot and said second elongated slot comprising a slot opening into which particles are drawn by vacuum, said slot opening comprising a length and a width perpendicular to said length, said slot opening comprising a first end at one extreme of said length, a second end at an opposite extreme of said length, and a width-transition point along said length between said first end and said second end, said width of said slot opening being non-tapered and consistent from said first end to said width-transition point, and said width of said slot opening being tapered and increasing from said width-transition point to said second end.

29. The printer of claim 28, said imaging drum comprising a transfix drum, said image transfer site comprising a transfix site, said one or more marking material dispensers comprising one or more ink jet print heads.

30. The device according to claim 28, said width-transition point being positioned about half-way between said first end and said second end.

31. The device according to claim 28, said width-transition point being positioned about two-fifths of said length from said first end.

32. The device according to claim 28, said width of said slot opening increasing from said width-transition point to said second end by a factor of about 2.

* * * * *